US006742654B2

(12) United States Patent
Tompkins

(10) Patent No.: US 6,742,654 B2
(45) Date of Patent: Jun. 1, 2004

(54) CONTAINER AND DISPLAY SYSTEM INCORPORATING THE CONTAINER

(75) Inventor: Robert D. Tompkins, Glenview, IL (US)

(73) Assignee: Walgreen Co., Deerfield, IL (US)

( * ) Notice: Subject to any disclaimer, the term of this patent is extended or adjusted under 35 U.S.C. 154(b) by 0 days.

(21) Appl. No.: 10/191,890

(22) Filed: Jul. 9, 2002

(65) Prior Publication Data

US 2004/0007491 A1 Jan. 15, 2004

(51) Int. Cl.[7] ..... B65D 85/00
(52) U.S. Cl. ..... 206/459.5; 206/581; 206/823
(58) Field of Search ..... 206/459.5, 581, 206/823, 457; 132/294, 301, 316

(56) References Cited

U.S. PATENT DOCUMENTS

| | | | | | |
|---|---|---|---|---|---|
| 476,765 | A | | 6/1892 | Knapp | |
| 838,031 | A | | 12/1906 | Kirkpatrick | |
| 1,128,052 | A | | 2/1915 | Roy | |
| 1,519,873 | A | * | 12/1924 | Mosonillo | 132/294 |
| 1,529,748 | A | * | 3/1925 | Morenus | 132/294 |
| 1,540,348 | A | * | 6/1925 | Loesser | 132/294 |
| 1,647,527 | A | * | 11/1927 | Kirby | 132/294 |
| 1,730,555 | A | * | 10/1929 | Brennan | 132/316 |
| 1,748,964 | A | * | 3/1930 | Wacker | 132/294 |
| 1,752,948 | A | * | 4/1930 | Herrmann | 190/108 |
| 2,011,660 | A | | 8/1935 | Sparkes | |
| 2,315,647 | A | | 4/1943 | Nyden | |
| 2,718,302 | A | | 9/1955 | Capaldi | |
| 3,182,884 | A | | 5/1965 | Waldron | |
| 3,417,861 | A | | 12/1968 | Levy | |
| 5,092,354 | A | * | 3/1992 | Pacelli, Jr. | 132/294 |
| 5,207,326 | A | * | 5/1993 | Benach | 206/424 |
| 5,320,219 | A | * | 6/1994 | Ward | 206/224 |
| 5,513,754 | A | * | 5/1996 | Chang | 206/581 |
| 5,638,838 | A | * | 6/1997 | Lombardi | 132/294 |
| 6,098,828 | A | * | 8/2000 | Shingleton | 220/23.4 |
| 6,129,089 | A | * | 10/2000 | Yuhara | 132/300 |
| 6,213,304 | B1 | * | 4/2001 | Juliussen | 206/581 |

* cited by examiner

*Primary Examiner*—Mickey Yu
*Assistant Examiner*—Troy Arnold
(74) *Attorney, Agent, or Firm*—Marshall, Gerstein & Borun LLP

(57) ABSTRACT

In order to provide a container and display system incorporating the container for a retail environment, the combination includes a product container and a display container. The product container comprises a base portion and a lid portion and, likewise, the display container comprises a base portion and a lid portion with the base portion being sized to hold a plurality of the product containers. Further, the display container also visibly displays at least one physical characteristic of the product container to a consumer who may wish to purchase the product.

19 Claims, 6 Drawing Sheets

CONTAINER AND DISPLAY SYSTEM INCORPORATING THE CONTAINER

FIELD OF THE INVENTION

The present invention relates to product merchandising and, more particularly, a container and display system incorporating the container.

BACKGROUND OF THE INVENTION

In the retail store environment, it has been recognized that there is a need for improved display systems for products that are containerized. For instance, the space which is available in a retail store must be utilized in a highly effective manner since many retail businesses display more consumer products than ever before. Since the cost of space is critical to retailers, it is also important to maximize the return that can be generated from the products that are displayed in a given space.

In addition, the manner in which products are displayed is known to have a significant impact on the ability to sell them to consumers within a retail store environment. Thus, if products are displayed in an attractive, highly visible and informative manner, it is far more likely that sales of products generated from such a display will be greater than might otherwise be expected. However, with conventional retail store displays for containerized products, there is little that can be accurately characterized as attractive, highly visible and informative merchandising.

While the foregoing holds true for sales of particular products, there is also the issue of enhancing the overall effectiveness of selling products at the point of purchase. Competition at the retail level is greater than ever before and, thus, retailers must present a shopping environment in which consumers are readily attracted to purchase certain products that are in the nature of impulse consumables. If a retail store has outmoded displays for containerized products, it is more likely that sales will not reach the levels that a retail store hopes to accomplish at the point of purchase.

With regard to certain small, inexpensive consumer products that are consumable in nature, e.g., lip moisturizer and the like, the interest of consumers is easily generated. This is particularly true at certain times of the year in various geographic regions where lip moisturizer and the like is consumed in relatively large quantities due to the climatic conditions which exist there. However, since there are many products of this type from which to choose, the manner of merchandising such products can be a critical element in achieving successful sales levels.

In addition, some products that are containerized may have one or more physical characteristics that are highly unique in nature. It is often the case that these physical characteristics are either not readily apparent from inspection of the container for the product or are entirely incapable of being viewed prior to purchase of the product. In these situations, it would be desirable for the display that is used for the product to demonstrate at least one such physical characteristic.

In view of the foregoing, there has remained a need for improvement in the manner of displaying retail products, particularly inexpensive consumable products, in an attractive, highly visible and informative fashion that captures the attention of the consumer at the point of purchase.

SUMMARY OF THE DISCLOSURE

Accordingly, the present disclosure is of a combination product container and display container. The product container comprises a base portion and a lid portion and, similarly, the display container comprises a base portion and a lid portion with the base portion of the display container being of a size to hold a plurality of the product containers therein. In addition, the display container visibly displays at least one physical characteristic of the product container to a consumer.

In one embodiment, the physical characteristic of the product container visibly displayed to a consumer by the display container is not visibly apparent from the product container. It may be, by way of example, that the physical characteristic is an internal characteristic of the product container. In particular, the internal characteristic of the product container visibly displayed to a consumer by the display container may be an inner surface that is reflective to function as a mirror.

Specifically, the reflective inner surface may be on the lid portion of the display container to visibly display that the lid portion of the product container also includes a reflective inner surface. A removable transparent protective film may be disposed on the reflective inner surface of the lid portion of the display container and have product information printed thereon. Still further, a removable transparent protective film may be disposed on the reflective inner surface of the lid portion of the product container to protect the reflective inner surface prior to purchase.

As for other features, the product container may include a hinge joining the lid portion of the product container to the base portion of the product container. It may then be advantageous for the lid portion of the display container to also be joined to the base portion of the display container by a hinge. In this regard, the hinge may comprise the physical characteristic of the product container which is visibly displayed to a consumer by the display container.

In another respect, the base portion of the product container may include a circular flat bottom wall and a cylindrical side wall to define a product receptacle and the lid portion of the product container may include a circular flat top wall and a cylindrical side wall to receive the side wall of the base portion of the product container. It is also the case that the cylindrical side wall of the lid portion of the product container may include a circumferential lip which is provided for facilitating the opening the lid portion of the product container relative to the base portion of the product container for access to a product contained in the product receptacle defined by the base portion of the product container. Still additionally, the cylindrical side wall of the lid portion of the product container may be joined to the circular flat top wall by an upstanding circumferential shoulder with the circular flat top wall being recessed relative to the upstanding circumferential shoulder to define a product label region for applying a product label to the product container.

Still further, if desired, a removable circumferential seal may be disposed about the periphery of the product container to secure the lid portion to the base portion in sealed relationship prior to purchase of the product by a consumer.

Other objects, advantages and features of the present disclosure will become apparent from a consideration of the following specification taken in conjunction with the accompanying drawings.

DETAILED DESCRIPTION OF THE ILLUSTRATED EMBODIMENT

Figure 1:
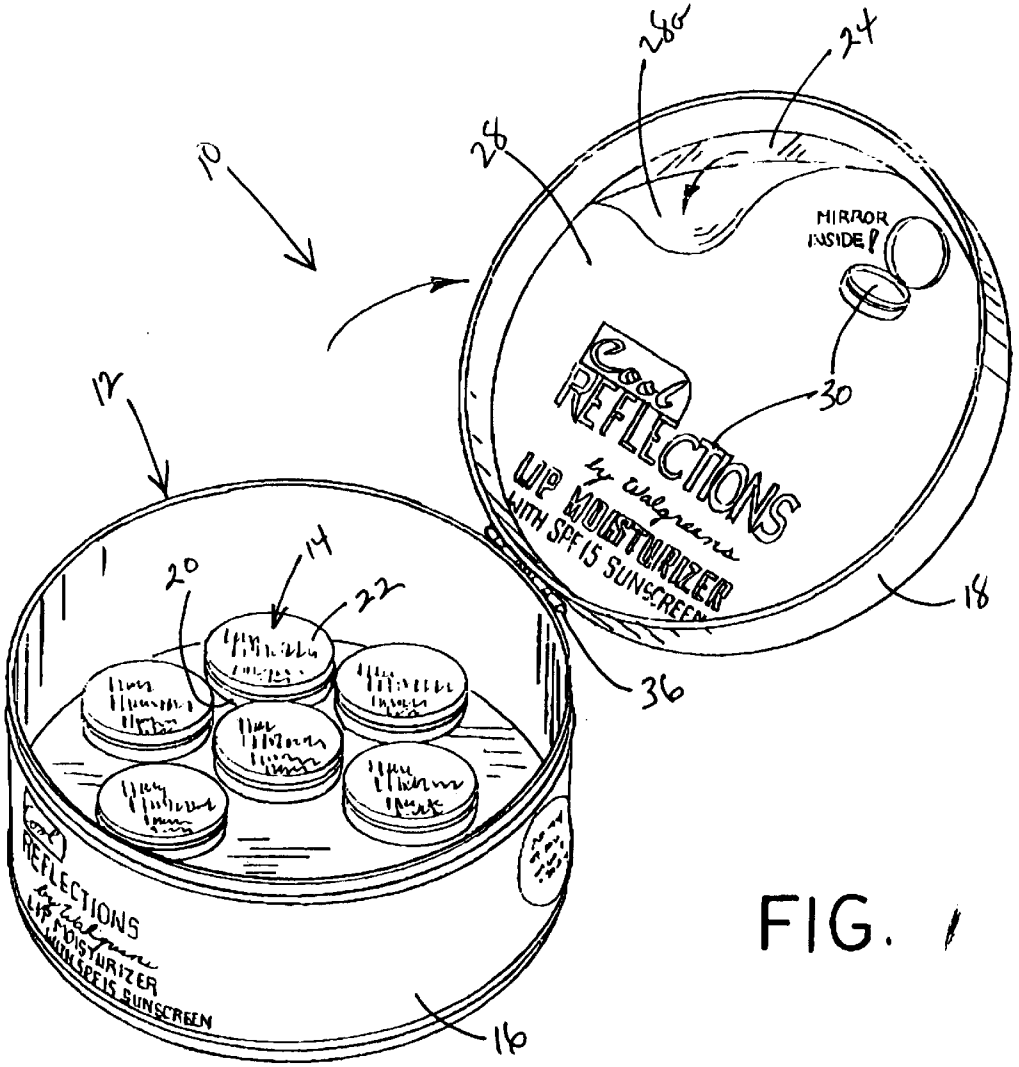
FIG. 1 is a perspective view of a container, and display system incorporating the container, in accordance with the disclosure.
Figure 2:
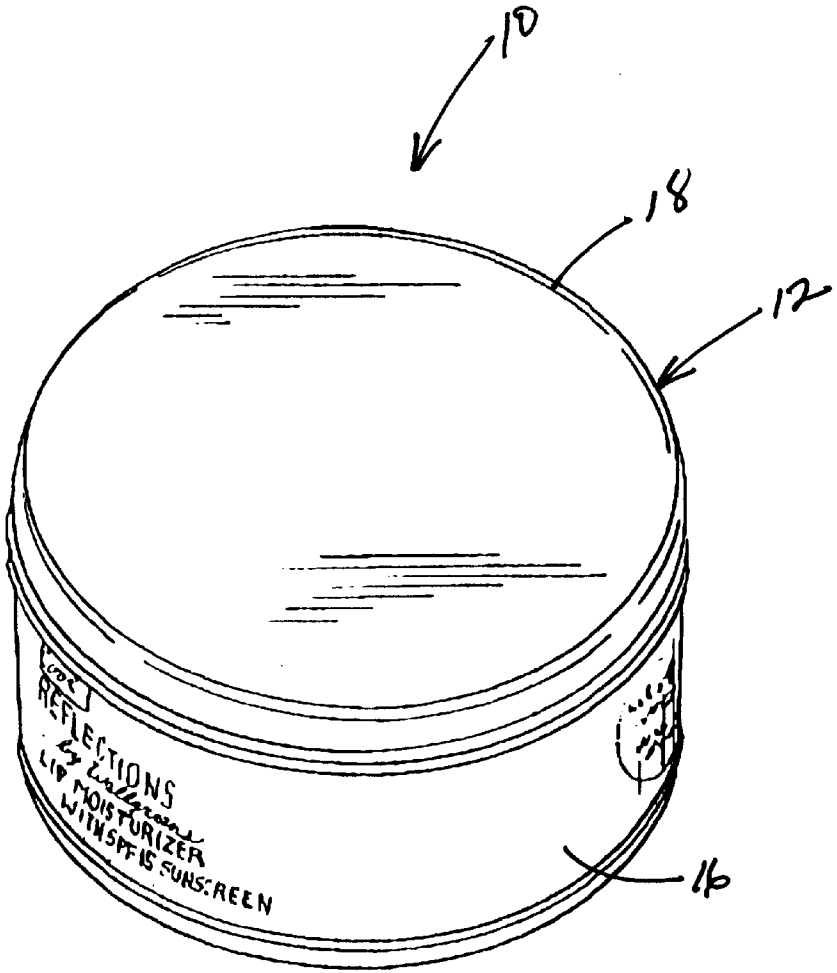
FIG. 2 is a perspective view of the display system of FIG. 1 with the lid portion of a display container in a closed position.
Figure 3:
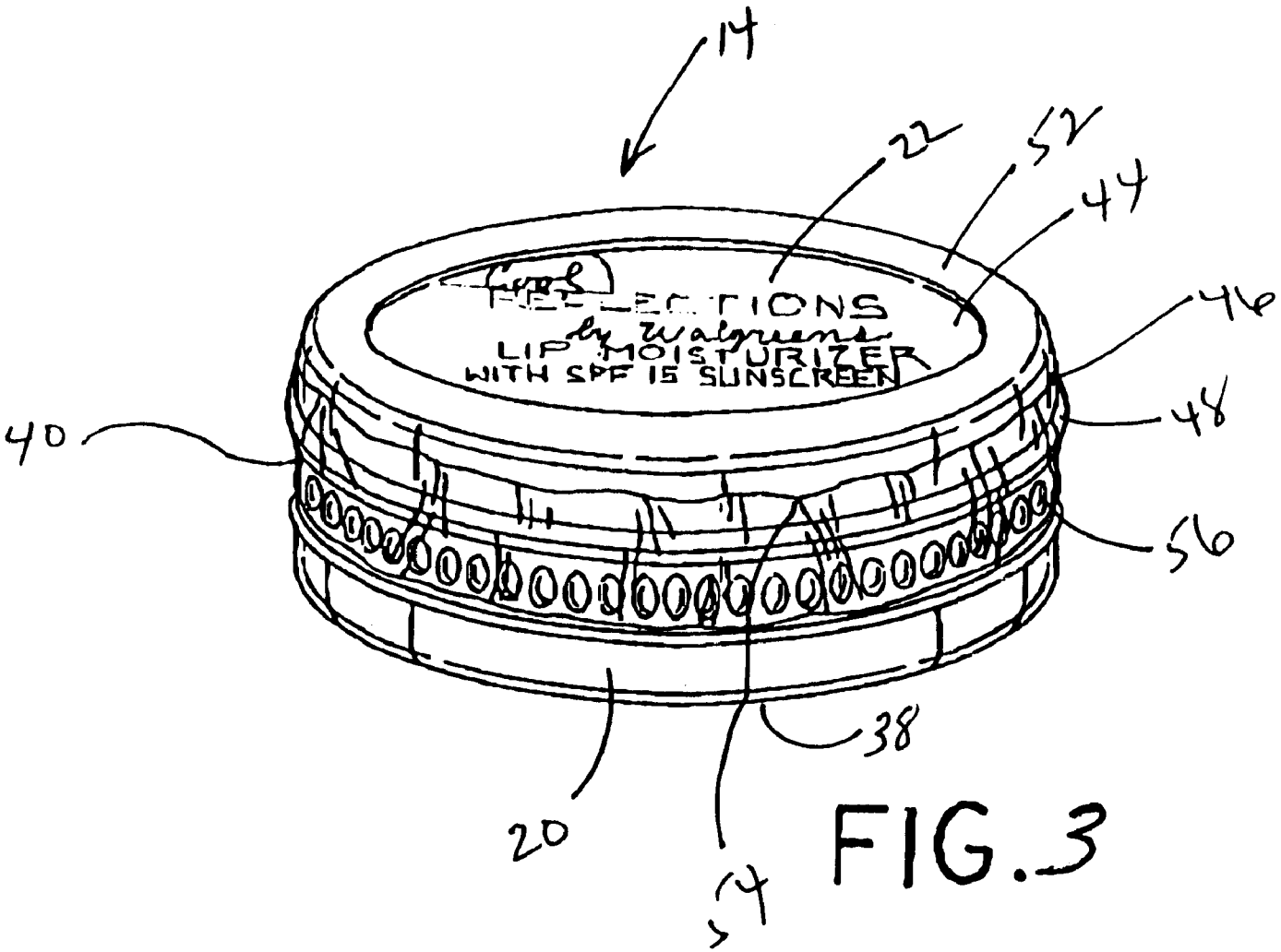
FIG. 3 is a perspective view of a product container to be displayed for sale in the display container of FIG. 1.

In the illustrations given, and with reference first to FIG. 1, the reference numeral 10 designates generally a container, and display system incorporating the container, in accordance with the illustrated embodiment. The embodiment 10 includes a display container 12 and a product container 14 wherein the display container 12 comprises a base portion 16 and a lid portion 18 and the product container 14 comprises a base portion 20 and a lid portion 22 (see, also, FIGS. 3 and 4). As will be appreciated from FIG. 1, the base portion 16 of the display container 12 is sized to hold a plurality of the product containers 14 in a manner in which the display container 12 can be placed at the point of purchase, if desired.

In one respect, the display container 12 also visibly displays at least one physical characteristic of the product container 14 to a consumer at, e.g., the point of purchase. The physical characteristic of the product container 14 that is visibly displayed to a consumer by the display container 12 may not be visibly apparent from a mere cursory inspection of the product container 14. In fact, the physical characteristic of the product container 14 visibly displayed by the display container 12 may comprise an internal characteristic of the product container 14.

In this connection, the internal characteristic of the product container 14 that is visibly displayed to a consumer by the display container 12 may be an inner surface such as 24 that is reflective to function as a mirror. The reflective inner surface 24, as shown in FIG. 1, may be of the lid portion 18 of the display container 12 to visibly display that the lid portion 22 of the product container 14 also includes a reflective inner surface 26 (see FIG. 4). The reflective inner surface 24 of the lid portion 18 of the display container 12 may also have a removable transparent protective film 28 having product information indicia such as 30 which has been printed thereon. In like manner, a removable transparent protective film 32 may be disposed on the reflective inner surface 26 of the lid portion 22 of the product container 14 to protect the reflective inner surface 26 prior to purchase of the product.

Referring to FIGS. 5–9, the product container 14 may include a hinge 34 joining the lid portion 22 of the product container 14 to the base portion 20 of the product container 14. It will also be seen from FIG. 1 that the lid portion 18 of the display container 12 is preferably joined to the base portion 16 of the display container 12 by a hinge 36. In this manner, the hinge 36 may be the at least one physical characteristic of the product container 14 which is visibly displayed to a consumer by the display container 12 at the point of purchase.

Figure 4:
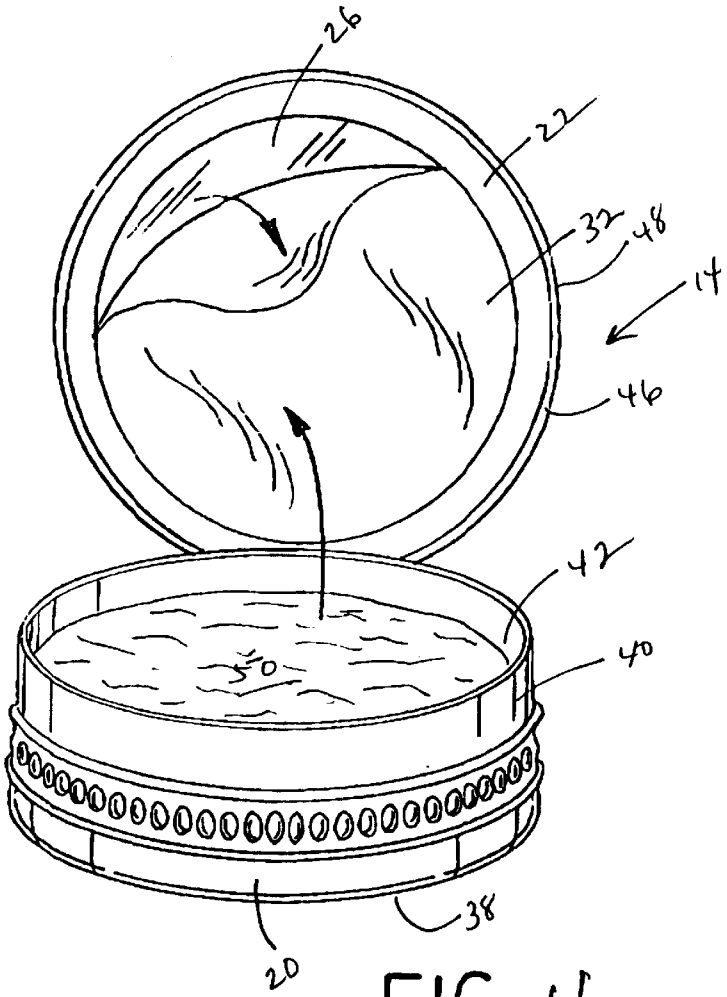
FIG. 4 is a perspective view of the product container of FIG. 3 with the lid portion in an open position.
Figure 7:
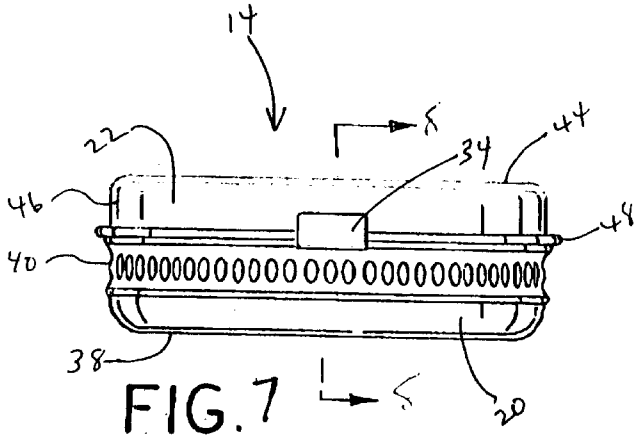
FIG. 7 is a rear elevation of the product container of FIG. 3.
Figure 6:
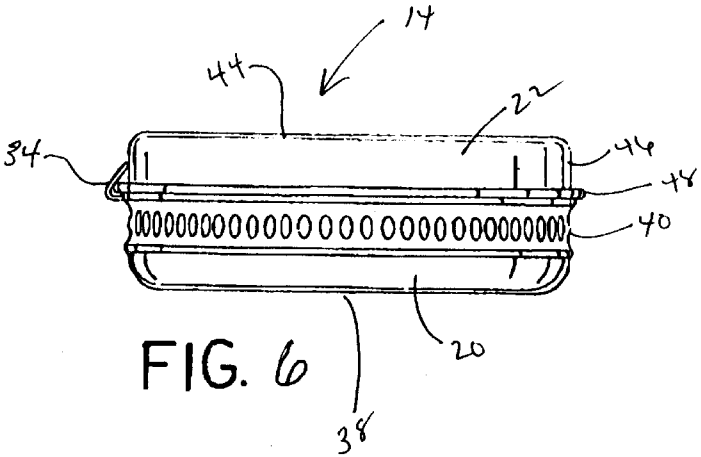
FIG. 6 is a left side elevation of the product container of FIG. 3.
Figure 5:
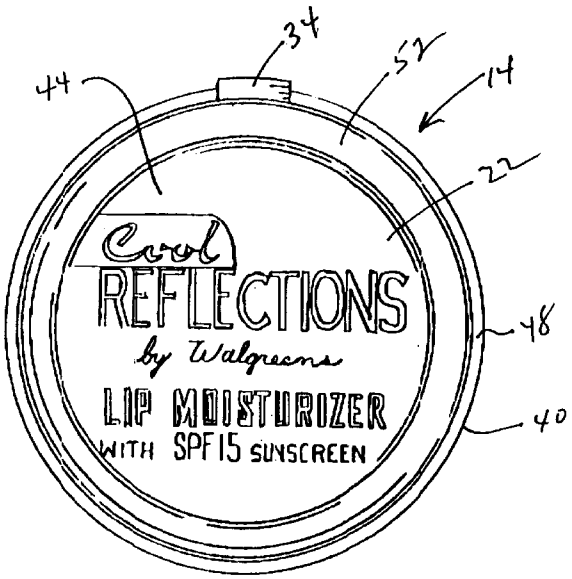
FIG. 5 is a top plan view of the product container of FIG. 3.
Figure 9:
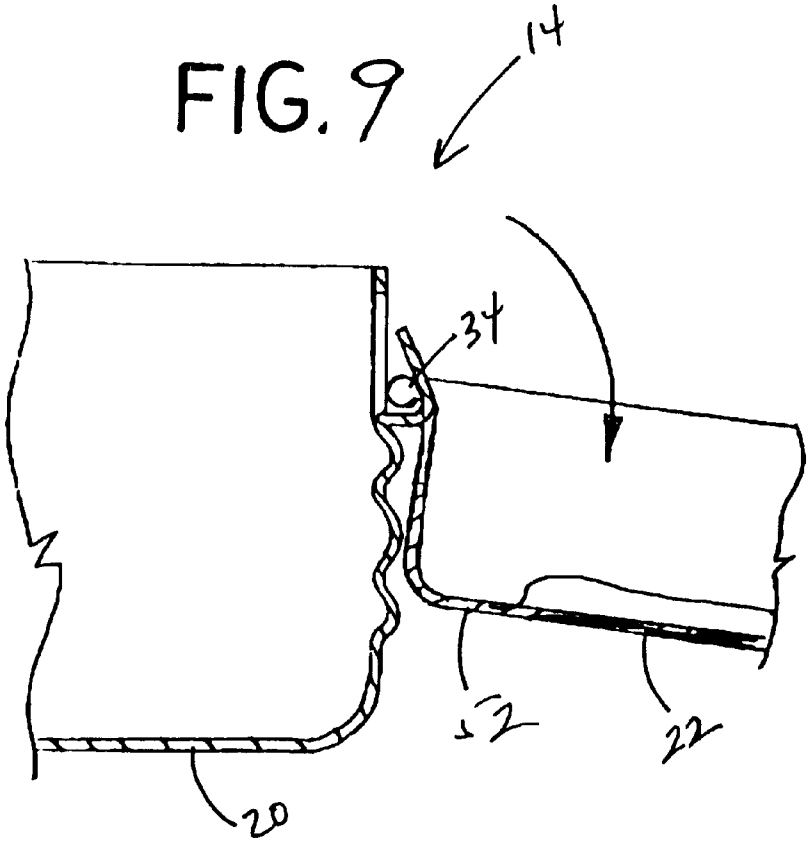
FIG. 9 is a view similar to FIG. 8 with the lid portion open.
Figure 8:
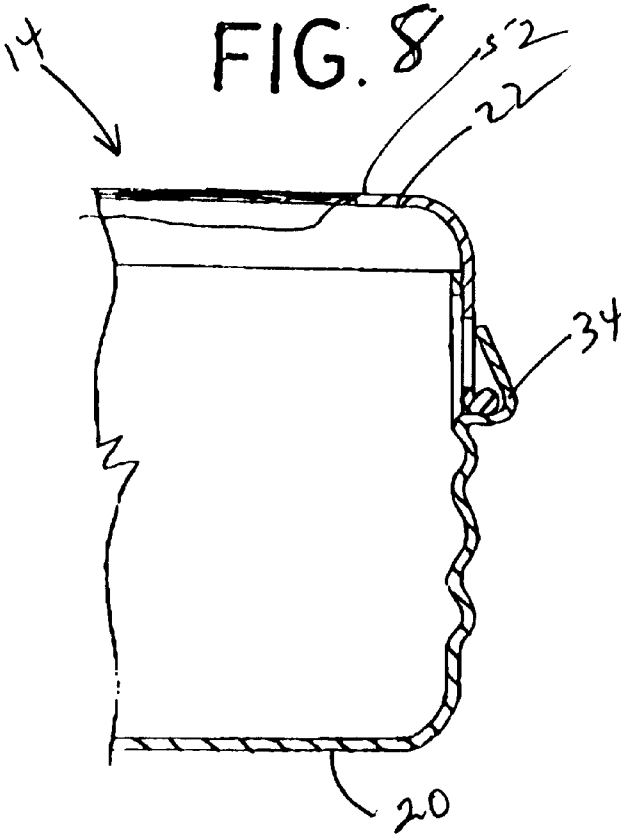
FIG. 8 is a cross-section taken along the line 8—8 of FIG. 7.

As previously mentioned, the lid portion 22 of the product container 14 includes an inner surface 26 that is reflective to function as a mirror when the lid portion 22 of the product container 14 is open (see FIG. 4). Also, the lid portion 18 of the display container 12 includes a reflective inner surface 24 to function as a mirror, as previously mentioned. As a result, it will be appreciated that the reflective inner surface 24 of the display container lid portion 18 may be the at least one physical characteristic visibly displayed to a consumer by the display container 12.

From a consideration of the display container 12 as illustrated in FIG. 1, it will be seen that the removable transparent protective film 28 may be formed with a folded over portion 28*a* to demonstrate this internal characteristic of the product container 14. It will be appreciated by the consumer from the folded over portion 28*a*, as well as the printed indicia 30, that the product container 14 contains a mirror inside protected by a removable transparent protective film such as 28. In addition, since the display container 12 closely resembles the product container 14 in shape and labeling, the consumer will appreciate that the display container 12 essentially demonstrates all of the physical characteristics of the product container 14.

Referring to FIGS. 3–7, the base portion 20 of the product container 14 includes a circular flat bottom wall 38 and a cylindrical side wall 40 to define a product receptacle 42 and the lid portion 22 of the product container 14 includes a circular flat top wall 44 and a cylindrical side wall 46 to receive the side wall 40 of the base portion 20 of the product container 14. The cylindrical side wall 46 of the lid portion 22 of the product container 14 may include a circumferential lip 48 to facilitate opening the lid portion 22 of the product container 14 relative to the base portion 20 of the product container 14 for access to a product such as lip moisturizer or lip balm 50 which is contained within the product receptacle 42 defined by the base portion 20 of the product container 14. Further, the cylindrical side wall 46 of the lid portion 22 of the product container 14 may be joined to the circular flat top wall 44 by an upstanding circumferential shoulder 52 with the circular flat top wall 44 being recessed relative to the upstanding circumferential shoulder 52 to define a product label region for the product container 14 to receive a suitable product label.

In yet another respect, and for consumer safety purposes, a circumferential seal 54 such as those of the transparent heat shrink variety may be disposed about the periphery of the product container 14. This serves to secure the lid portion 22 to the base portion 20 in sealed relationship prior to purchase of the product by a consumer. If desired, the product container 14 may also include a beaded periphery 56 about the base portion 20 to facilitate gripping the base portion 20 when the lip 48 is used to open the lid portion 22 to the position shown in FIG. 4.

While in the foregoing, there has been set forth an embodiment of the disclosure, it will be appreciated that the details herein given may be varied by those skilled in the art without departing from the true spirit and scope of the invention which is defined in and covered by the appended claims.

What is claimed is:

1. In combination, a product container and display container, wherein:

the product container comprises a base portion and a lid portion, a hinge joining the lid portion of the product container to the base portion of the product container, the lid portion of the product container shiftable between a closed position and an open position, the product container including a plurality of physical characteristics visible to a user, the characteristics including a mirrored surface on the lid portion of the product container, the mirrored surface visible exclusively when the lid portion of the product container is in the open position, the characteristics further including printed indicia visible when the lid portion of the product container is in either the open position or the closed position; and the display container comprises a base portion and a lid portion, the base portion of the display container being sized to hold a plurality of the product containers, the lid portion of the display container shiftable between a closed position and an open position, the display container including physical characteristics visible to a user and structured to resemble the physical characteristics of the product container, the physical characteristics including a mirrored surface visible exclusively when the lid portion of the display container is in the open position, the characteristics further including printed indicia visible when the lid portion of the display container is in either the open position or the closed position, the display container visibly displaying the indicia and further indicating the presence of the mirrored surface on the product container when the lid portion of the display container is in the open position and the lid portion of the product container is in the closed position.

2. The combination of claim 1 wherein the display container includes a hinge joining the lid portion of the display container to the base portion of the display container, wherein the hinge joining the display container lid portion to the display container base portion comprises another physical characteristic visibly displayed to a consumer by the display container.

3. The combination of claim 1 wherein the base portion of the product container includes a circular flat bottom wall and a cylindrical side wall to define a product receptacle and the lid portion of the product container includes a circular flat top wall and a cylindrical side wall to receive the side wall of the base portion of the product container.

4. The combination of claim 3 wherein the cylindrical side wall of the lid portion of the product container includes a circumferential lip for opening the lid portion of the product container relative to the base portion of the product container for access to a product contained in the product receptacle defined by the base portion of the product container.

5. The combination of claim 3 wherein the cylindrical side wall of the lid portion of the product container is joined to the circular flat top wall by an upstanding circumferential shoulder with the circular flat top wall being recessed relative to the upstanding circumferential shoulder to define a product label region for placement of a label on the product container.

6. The combination of claim 1 wherein the mirrored surface of the display container is formed on an inner surface of the lid portion of the display container.

7. The combination of claim 1 wherein the base portion of the product container includes a circular flat bottom wall and a cylindrical side wall to define a product receptacle and the lid portion of the product container includes a circular flat top wall and a cylindrical side wall to receive the side wall of the base portion of the product container.

8. The combination of claim 7 wherein the cylindrical side wall of the lid portion of the product container includes a circumferential lip for opening the lid portion of the product container relative to the base portion of the product container for access to a product contained in the product receptacle defined by the base portion of the product container.

9. The combination of claim 7 wherein the cylindrical side wall of the lid portion of the product container is joined to the circular flat top wall by an upstanding circumferential shoulder with the circular flat top wall being recessed relative to the upstanding circumferential shoulder to define a product label region for applying a label to the product container.

10. The combination of claim 1 including a circumferential seal disposed about a periphery of the product container to secure the lid portion to the base portion in sealed relationship prior to purchase by a consumer.

11. In combination, a product container and display container, wherein:

the product container comprises a base portion and a lid portion, the lid portion of the product container shiftable between an open position and a closed position, the product container further comprising a mirrored surface formed on an inner surface of the lid portion of the product container, the mirrored surface of the product container not visible to a consumer when the lid portion of the product container is in the closed position; and the display container comprises a base portion and a lid portion, wherein the base portion of the display container is sized to hold more than one product container, the lid portion of the display container shiftable between an open position in which the product container when placed in the display container will remain visible and a closed position in which the product container when placed in the display container will remain concealed, the display container comprising a mirrored surface disposed on an inner surface of the lid of the display container, and wherein the inner surface of the lid of the display container is structured to indicate the presence of a mirrored surface disposed on an inner surface of the lid of the product container, and wherein the mirrored surface of the lid of the display container includes a removable transparent protective film, and wherein the protective film includes product information indicia printed thereon.

12. The combination of claim 11 including a removable transparent protective film disposed on the mirrored inner surface of the lid portion of the product container to protect the mirrored inner surface.

13. The combination of claim 11 wherein the product container includes a hinge joining the lid portion of the product container to the base portion of the product container.

14. The combination of claim 13 wherein the lid portion of the display container is joined to the base portion of the display container by a hinge, the hinge joining the display container lid portion to the display container base portion is the at least one physical characteristic visibly displayed by the display container.

15. A system for displaying products comprising:

a product container, the product container having a base adapted to hold product and a lid, the lid of the product container shiftable between a closed position in which the lid closes the base and conceals the product and an open position in which the lid opens the base and reveals the product, the product container having a plurality of physical characteristics, a first one of the physical characteristics visible to a user when the lid is in the closed position and a second one of the physical characteristics visible to a user exclusively when the lid is in the open position;

a display container, the display container having a base and a lid, the base having an interior sized to hold a plurality of the product containers, the lid of the display container shiftable between a closed position in which the lid closes the base and conceals the interior and an open position in which the lid opens the base and reveals the interior, the display container having a plurality of physical characteristics including a first physical characteristic matching the first physical characteristic of the product container and a second physical characteristic matching the second physical characteristic of the product container and visible exclusively when the lid of the display container is in the open position;

wherein the first physical characteristic of the display container is visible to a user when the lid of the display container is in the closed position, and both the first and second physical characteristic of the display container are visible to a user when the lid of the display container is in the open position; and wherein the lid of the product container and the lid of the display container each include a round mirrored inner surface covered at least in part by a removable transparent inner film.

16. The system of claim 15 wherein the lid of the display container is joined to the base of the display container by a hinge, the lid of the product container being joined to the base of the product container by a hinge, and wherein the hinge of the product container comprises another one of the physical characteristics of the product container.

17. The system of claim 15, wherein the film includes indicia imprinted thereon.

18. The system of claim a 17, wherein the lid of the product container is connected to the base of the product container by a hinge, and further wherein the lid of the display container is connected to the base of the display container by a hinge.

19. A system for displaying products comprising:

a product container, the product container having a base adapted to hold product and a lid, the lid of the product container shiftable between a closed position in which the lid closes the base and conceals the product and an open position in which the lid opens the base and reveals the product, the product container having a plurality of physical characteristics, a first one of the physical characteristics visible to a user when the lid is in the closed position and a second one of the physical characteristics visible to a user exclusively when the lid is in the open position;

a display container, the display container having a base and a lid, the base having an interior sized to hold a plurality of the product containers, the lid of the display container shiftable between a closed position in which the lid closes the base and conceals the interior and an open position in which the lid opens the base and reveals the interior, the display container having a plurality of physical characteristics including a first physical characteristic matching the first physical characteristic of the product container and a second physical characteristic matching the second physical characteristic of the product container and visible exclusively when the lid of the display container is in the open position;

wherein the first physical characteristic of the display container is visible to a user when the lid of the display container is in the closed position, and both the first and second physical characteristic of the display container are visible to a user when the lid of the display container is in the open position; and wherein the lid of the product container and the lid of the display container each include a mirrored inner surface, the mirrored inner surface of each of the container comprising the second physical characteristic of each of the product container and the display container, and further wherein the mirrored inner surface of the lid of the product container and the mirrored inner surface of the lid of the display container are covered by a removable transparent film, the removable transparent film of each of the containers including indicia imprinted thereon, and further wherein the removable transparent film comprises a third physical characteristic of each of the product container and the display container.

* * * * *

UNITED STATES PATENT AND TRADEMARK OFFICE

CERTIFICATE OF CORRECTION

PATENT NO. : 6,742,654 B2
DATED : June 1, 2004
INVENTOR(S) : Robert D. Tompkins

It is certified that error appears in the above-identified patent and that said Letters Patent is hereby corrected as shown below:

Column 7,
Line 37, delete “a 17,” and insert instead -- 17, --.

Signed and Sealed this

Twenty-sixth Day of October, 2004

JON W. DUDAS
*Director of the United States Patent and Trademark Office*